US008638265B2

(12) United States Patent
Mahanfar

(10) Patent No.: US 8,638,265 B2
(45) Date of Patent: Jan. 28, 2014

(54) SLOT ANTENNA

(75) Inventor: Alireza Mahanfar, Bellevue, WA (US)

(73) Assignee: Microsoft Corporation, Redmond, WA (US)

( * ) Notice: Subject to any disclaimer, the term of this patent is extended or adjusted under 35 U.S.C. 154(b) by 391 days.

(21) Appl. No.: 13/046,276

(22) Filed: Mar. 11, 2011

(65) Prior Publication Data

US 2012/0231846 A1 Sep. 13, 2012

(51) Int. Cl.
*H01Q 13/10* (2006.01)
*H01Q 1/24* (2006.01)

(52) U.S. Cl.
USPC ..... 343/767; 343/702; 343/846

(58) Field of Classification Search
USPC ..... 343/767, 770, 702, 846
See application file for complete search history.

(56) References Cited

U.S. PATENT DOCUMENTS

| | | | | |
|---|---|---|---|---|
| 6,429,818 | B1 | 8/2002 | Johnson et al. | |
| 7,023,387 | B2 | 4/2006 | Wen et al. | |
| 7,034,762 | B2 | 4/2006 | Huang | |
| 8,054,231 | B2 * | 11/2011 | Ahn et al. | 343/702 |
| 2008/0231532 | A1 | 9/2008 | Rao et al. | |
| 2008/0266181 | A1 | 10/2008 | Ying | |
| 2009/0153416 | A1 * | 6/2009 | Arbin et al. | 343/702 |
| 2009/0231215 | A1 * | 9/2009 | Taura | 343/702 |
| 2010/0123632 | A1 * | 5/2010 | Hill et al. | 343/702 |
| 2011/0254741 | A1 * | 10/2011 | Ishimiya | 343/702 |

OTHER PUBLICATIONS

Zhang, et al., "High-gain Broad-Band Cavity-Backed Slot Antenna for WLAN Applications", Retrieved at << http://ieeexplore.ieee.org/stamp/stamp.jsp?tp=&arnumber=4540846 >>, International Conference on Microwave and Millimeter Wave Technology, Apr. 21-24, 2008, pp. 3.

Sharma, et al., "Investigations on Low Profile Wide Band Slot Antennas for Wireless Communications", Retrieved at << http://www.ursi.org/Proceedings/ProcGA02/papers/p1166.pdf >>, XXVIIth General Assembly URSI (URSI), Aug. 17-24, 2002, pp. 4.

* cited by examiner

*Primary Examiner* — Hoang V Nguyen
(74) *Attorney, Agent, or Firm* — Wolfe-SBMC

(57) ABSTRACT

Techniques involving a slot antenna and associated functionality are described. In one or more implementations, the techniques describe a slot antenna that is usable for wireless communication in a mobile communication device. The mobile communication device may include one or more modules communicatively coupled to the slot antenna and configured to employ the slot antenna to enable the wireless communication.

20 Claims, 6 Drawing Sheets

SLOT ANTENNA

BACKGROUND

Designs for computing devices are ever changing. However, these designs are often limited by hardware components which enable device functionality. For example, hardware components affect certain aspects of a design, such as size, structure, and/or robustness.

In one example, a device component may include an antenna used for wireless communication. Conventional antenna design for mobile computing devices use internal or external wire antennas such as monopoles or loops, or variants of these. However, these conventional antennas may limit the internal and/or external structure of the mobile computing devices because a substantial amount of metal-free area is generally used for the antennas to function properly. Thus, traditional antennas may compromise visual quality and mechanical robustness of the computing devices, resulting in reduced user satisfaction.

SUMMARY

Techniques involving slot antennas and other functionality are described. In one or more implementations, a slot antenna is usable for wireless communication in a mobile communication device. The mobile communication device may include one or more modules communicatively coupled to the slot antenna and configured to employ the slot antenna to enable the wireless communication.

In other embodiments, a phone may include a housing with an amount of metal sufficient to establish a finite ground plane. The housing may also have a slot formed within the metal. Additionally, the phone may include one or more modules configured to use the finite ground plane and the slot as an antenna to perform wireless communication.

In other embodiments, a phone is used that includes a housing with a slot formed therein to establish an operating frequency for communicating over a wireless network. Additionally, a wireless connection is established between the phone and a remote device over the wireless network based on the operating frequency.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different instances in the description and the figures may indicate similar or identical items.

DETAILED DESCRIPTION

Overview

Conventional techniques that were used to communicate wirelessly via a mobile computing device may limit certain aspects of the mobile communication device, such as size, visual quality, and/or mechanical robustness, at least by affecting the computing device's internal and/or external structure. For example, traditional antennas used for wireless communication in computing devices include monopoles and loops, or variants of these, which involve use of a metal-free area around the antenna to minimize signal interference. These metal-free areas may force a computing device to be formed substantially from non-metal materials. However, for thin devices, non-metal materials may lack robustness and durability desired by consumers and designers of the device. Therefore, these conventional techniques may result in decreased user satisfaction regarding bulkiness, sturdiness, and/or durability of a computing device.

For instance, there may be more than 10 different radios in a 3G or 4G mobile communication device (e.g., 8-10 cellular bands, Global Positioning System (GPS), Bluetooth, Wi-Fi, etc.), which traditionally involved multiple antennas, which may utilize a substantial metal-free volume within the device in order to function properly. However, a handheld device, such as a smartphone, may lack robustness if it is formed substantially from a non-metal material, lack desired design characteristics due to these constraints, and so on. Further, robustness of such a substantially non-metal handheld device may decrease with a thinner structure.

Slot antennas are described. Slot antennas may be formed as dual of dipoles and conventionally use what is commonly referred to as a physically infinite ground plane. However, in the following discussion, a variety of different implementations are described that involve slot antennas to enable wireless communication of a mobile communication device. For example, in one or more implementations, a computing device may include a metal housing with a slot configured to enable wireless communication. Use of a slot antenna may reduce non-metal areas implemented in the housing, thereby providing additional options to designers of the device. Further discussion of this and other implementations that involve use of slot antennas may be found in the following sections.

In the following discussion, an example environment is first described that is operable to employ techniques using slot antennas described herein. Example illustrations of slot antennas and procedures involving the slot antennas are then described, which may be employed in the example environment as well as in other environments. Accordingly, the example environment is not limited to performing the example procedures. Likewise, the example procedures are not limited to implementation in the example environment.

Example Environment

Figure 1:
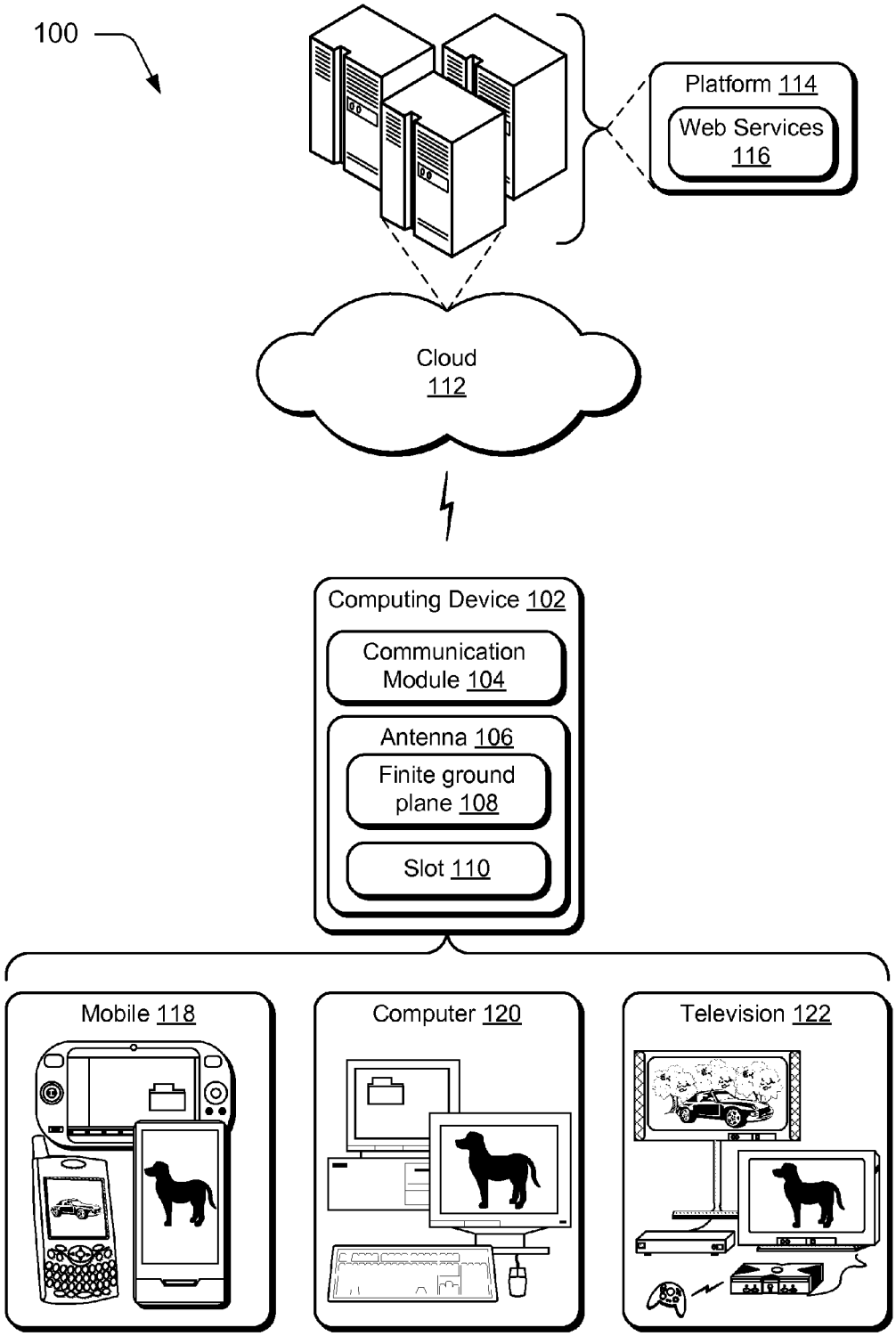
FIG. 1 is an illustration of an environment in an example implementation that is operable to employ a slot antenna.

FIG. 1 is an illustration of an environment 100 in an example implementation that is operable to employ techniques for slot antennas. The illustrated environment 100 includes an example of a computing device 102 that includes a communication module 104 and an antenna 106, which are communicatively coupled to each other. The antenna 106 may include a finite ground plane 108 and a slot 110 formed in the plane 108. The illustrated environment 100 also includes a cloud 112, such as a network or the Internet, and one or more platforms 114 for web services 116, and the like.

The computing device 102 may assume a variety of different configurations, such as for mobile 118, computer 120, and television 122 uses. Each of these configurations has a generally corresponding screen size and thus the computing device 102 may be configured accordingly to one or more of these device classes in this example environment 100. For instance, the computing device 102 may assume the mobile 118 class of device which includes mobile phones, portable music players, game devices, and so on. The mobile 118 class of device may also include handheld devices such as personal digital assistants (PDA), mobile computers, digital cameras, and so on. The computing device 102 may also assume a computer 120 class of device that includes personal computers, laptop computers, netbooks, and so on. The television 122 configuration includes configurations of devices that involve display on a generally larger screen in a casual environment, e.g., televisions, set-top boxes, game consoles, and so on. Thus, the techniques described herein may be supported by these various configurations of the computing device 102 and are not limited to the specific examples described in the following sections.

The communication module 104 is representative of functionality associated with communicating with one or more other devices over the cloud 112. For example, the communication module 104 may be configured to employ the antenna 106 to establish a frequency for transmitting data to and/or receiving data from another device.

The antenna 106 may assume a variety of different configurations. In one or more embodiments, the antenna 106 may be formed from the finite ground plane 108 and the slot 110 configured therein. The antenna 106 may represent functionality associated with multiple bands of operation. In addition, the antenna 106 may be configured for multiple modes for multiple radios operating in different frequencies, where the modes support antenna functionality associated with multiple bands of operation. Further discussion of the antenna 106, the finite ground plane 108, and the slot 110 may be found below in the discussion of FIG. 2.

The cloud 112 is illustrated as including a platform 114 for web services 116. The platform 114 abstracts underlying functionality of hardware (e.g., servers) and software resources of the cloud 112 and thus may act as a "cloud operating system." For example, the platform 114 may abstract resources to connect the computing device 102 with other computing devices. The platform 114 may also serve to abstract scaling of resources to provide a corresponding level of scale to encountered demand for the web services 116 that are implemented via the platform 114. A variety of other examples are also contemplated, such as load balancing of servers in a server farm, protection against malicious parties (e.g., spam, viruses, and other malware), and so on. Thus, web services 116 and other functionality may be supported without the functionality "having to know" the particulars of the supporting hardware, software, and network resources.

Generally, any of the functions described herein can be implemented using software, firmware, hardware (e.g., fixed logic circuitry), manual processing, or a combination of these implementations. The terms "module," "functionality," and "logic" as used herein generally represent software, firmware, hardware, or a combination thereof. In the case of a software implementation, the module, functionality, or logic represents program code that performs specified tasks when executed on a processor (e.g., CPU(s) or GPU(s)). The program code can be stored in one or more computer readable memory devices. The features of the slot antenna described below are platform-independent, meaning that the techniques may be implemented on a variety of commercial computing platforms having a variety of processors.

Figure 2:
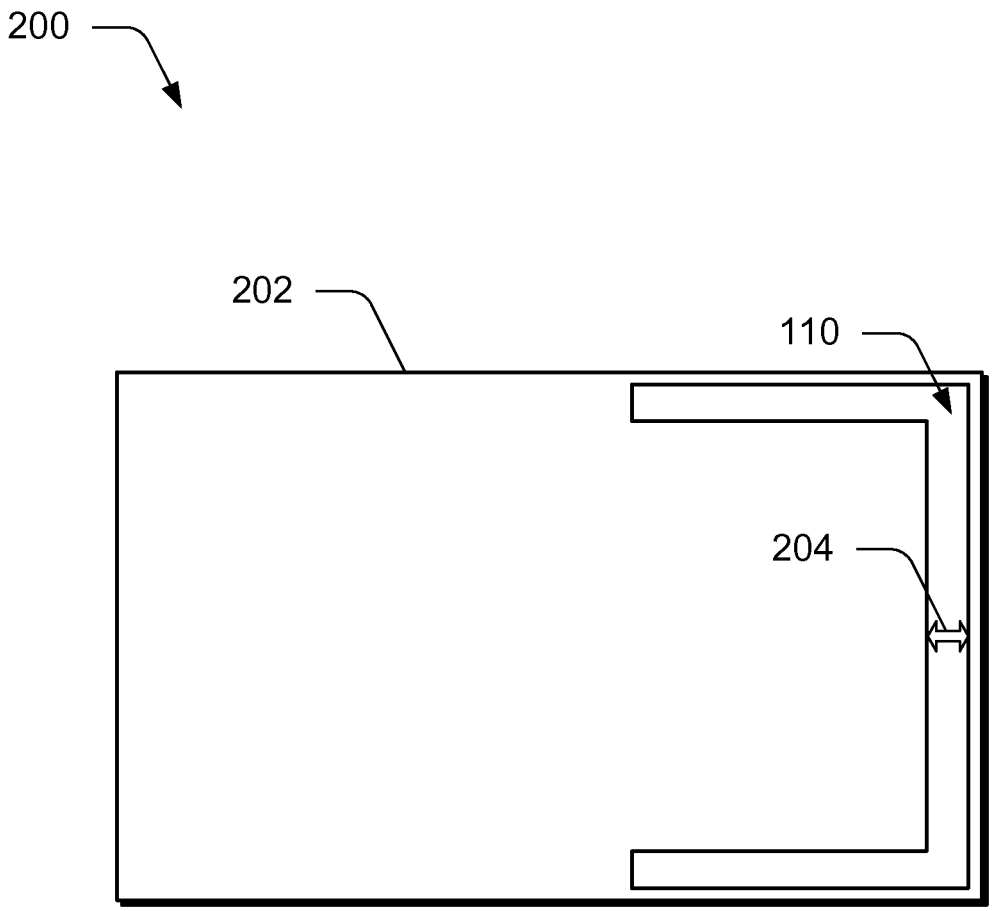
FIG. 2 illustrates an example implementation of a slot antenna in accordance with one or more embodiments.

FIG. 2 illustrates an example implementation 200 that is operable to employ a slot antenna. For example, the example implementation 200 includes a housing 202 and the slot 110, referred to in FIG. 1. The housing 202 may be formed substantially from metal in order to establish a conductive surface sufficient for wireless communication. Traditionally, slot antennas used an infinitely large ground plane (e.g., airplanes or aircraft carriers). However, a unibody of metal in the computing device 102 may be configured to support a wideband slot antenna. For example, a metal housing 202 may be used as the finite ground plane to support the antenna. The slot 110 may be formed within the housing 202 to enable transmission of ground and signal, thus forming the slot antenna.

In embodiments, the housing 202 may form the supporting structure of the computing device. Alternatively, the housing 202 may be a component of the computing device. The slot antenna, formed by the housing 202 with the slot 110, may therefore be formed from the supporting structure of the device or some component of the device.

In addition, the slot 110 may include a variety of different shapes. For instance, the slot 110 may be formed in a rectangular shape, a "U" shape, and the like. Slots formed by different shapes may be configured for similar frequencies by adjusting a length of the slot, in one or more implementations.

Figure 3:
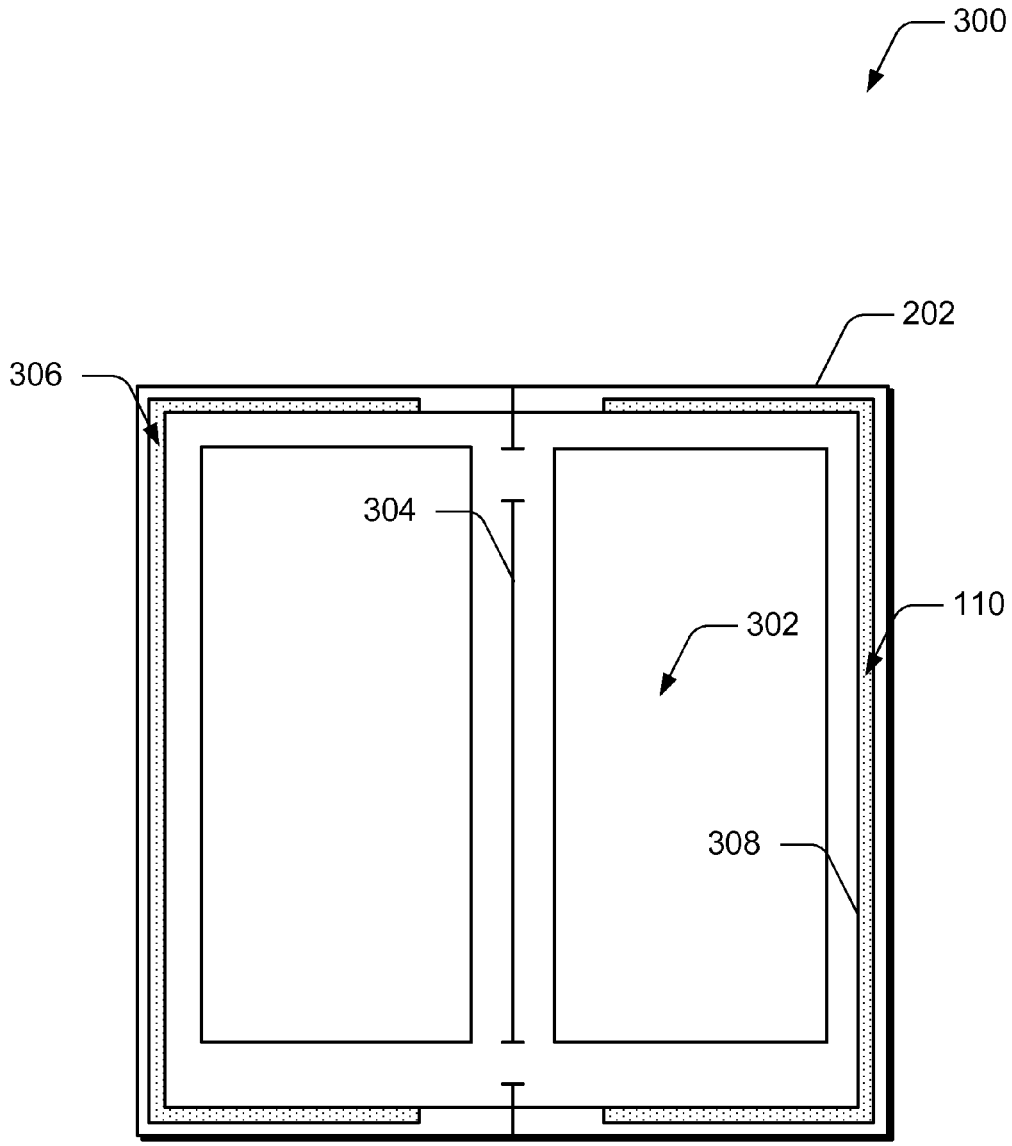
FIG. 3 illustrates an example system in which embodiments of a slot antenna can be implemented.

Consider now FIG. 3, which illustrates an example system 300 in which embodiments of a slot antenna can be implemented. The example system 300 includes a housing 202, one or more slots 110, and one or more display screens 302. In addition, the example system 300 may include a computing device 102, as referred to in FIG. 1, and may be foldable along a centerline 304. For example, the device may be foldable via one or more hinges, pivots, axles, and the like. Additionally, the device may be operable in a closed mode (e.g., folded position) and/or an open mode (e.g., unfolded position). Both the closed and open modes of operation may include antenna function for wireless communication in either mode.

The example system 300 illustrated in FIG. 3 is shown in open mode and may include one or more display screens. The one or more display screens may each be communicatively coupled to separate antennas for communicating with different remote devices based on different frequencies. Alternatively, the one or more display screens may be communicatively coupled to a same antenna and one to another to generate a dual display.

Continuing the above example, the device is foldable into first and second portions. The first portion may include a slot 110 formed in the housing 202 to establish an antenna. The second portion may be configured such as not to block the antenna on the first portion. In order to not block the antenna on the first portion, the second portion may be structured such that the second portion does not physically cover the slot 110 on the first portion when the device is folded into the closed position. For example, the second portion may also include a slot 306 substantially similar to the slot 110 on the first portion so as to reduce the metal on the housing that might block the signal to/from the slot 110 on the first portion. Alternatively, as illustrated in FIG. 4, the second portion may be structured to remain within the bounds of the interior wall 308 of the slot 110 on the first portion when the device is folded in the closed position.

Figure 4:
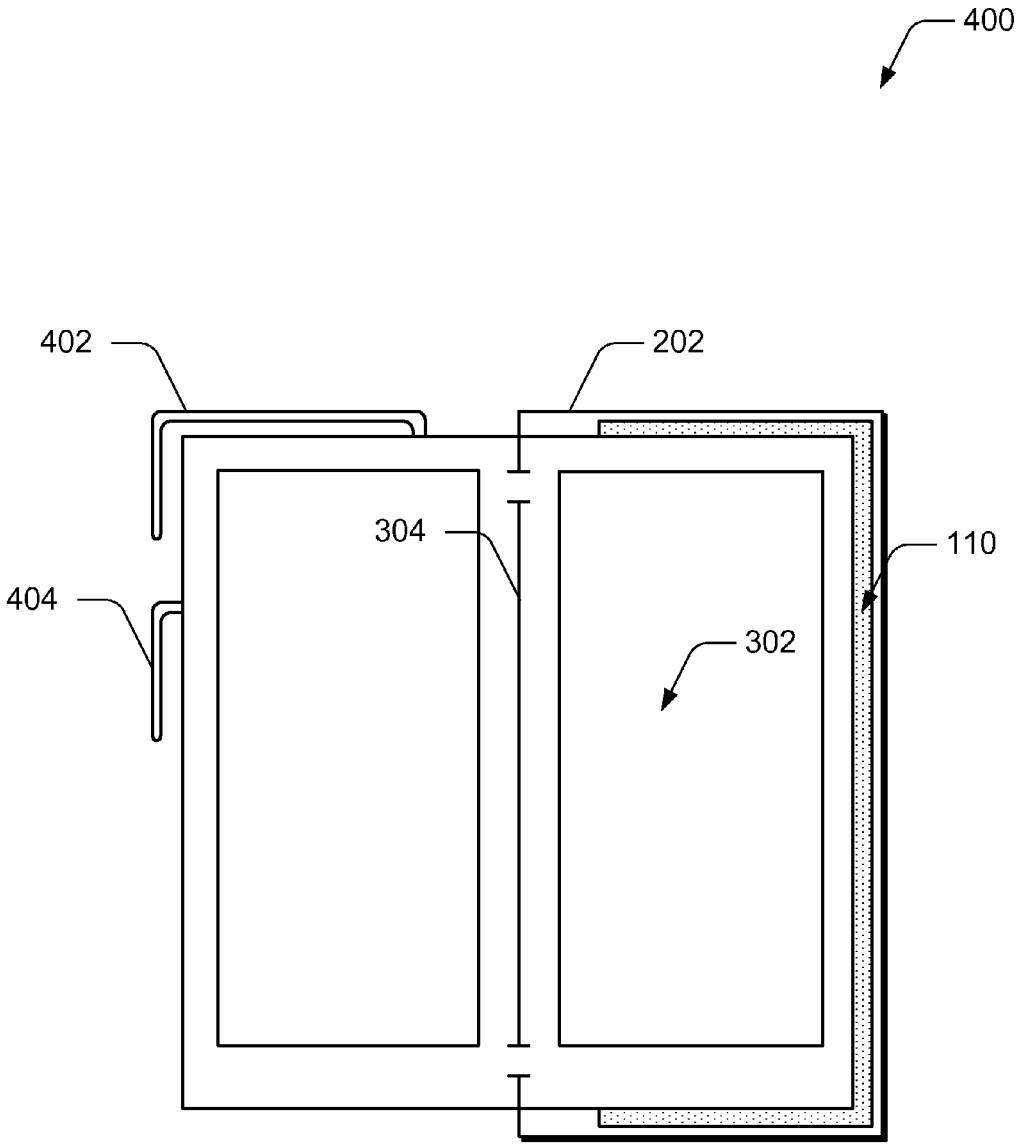
FIG. 4 illustrates an example system in which embodiments of a slot antenna can be implemented.

FIG. 4 illustrates an example embodiment of a system 400 that includes a device with multiple antennas having different configurations. The device may include a housing 202 and a slot 110 to form a slot antenna, one or more display screens 302, and one or more additional antennas 402, 404 that are different than the slot antenna. The different antennas 402, 404 may include one or more antennas that support one or more frequencies not supported by the slot antenna. The different antennas 402, 404 may also function as a diversity antenna or a secondary antenna in a Multiple-Input-Multiple-Output (MIMO) system (or MIMO handheld terminal). A variety of different antennas are contemplated. This may provide increased variety of bands for communication with other devices thereby providing increased versatility for a user. In addition, the example system 400 may include a display screen on an exterior surface for displaying a user interface when the device is folded in the closed position.

Figure 5:
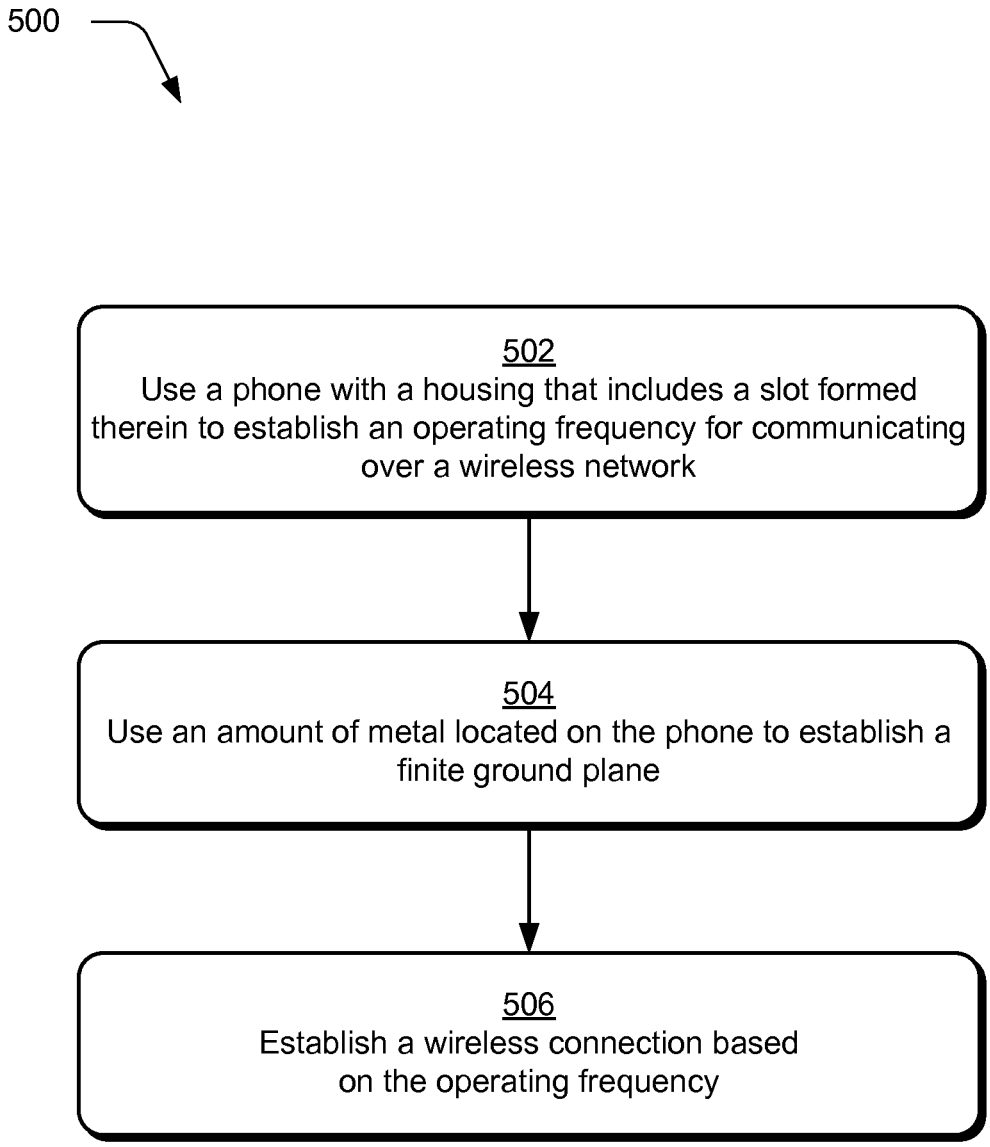
FIG. 5 illustrates an example technique for utilizing a slot antenna in accordance with one or more embodiments.

FIG. 5 is a flow diagram that depicts a procedure 500 in an example implementation of a slot antenna in accordance with one or more embodiments. Aspects of the procedure may be implemented in hardware, firmware, software, or a combination thereof. The procedure is shown as a set of blocks in this example that specify operations performed by one or more devices and are not necessarily limited to the orders shown for performing the operations by the respective blocks. In portions of the following discussion, reference will be made to the environment 100 of FIG. 1, the example implementation 200 of FIG. 2, and the systems 300 and 400 of FIGS. 3 and 4, respectively.

A phone that includes a housing with a slot formed therein is used to establish an operating frequency for communicating over a wireless network (block 502). For example, the housing may be formed of metal to establish a finite ground plane and, combined with the slot, may form a slot antenna. The slot antenna may be used to establish a frequency (e.g., radio frequency) for communicating wirelessly with another device.

An amount of metal located on the phone is used to establish the finite ground plane (block 504). For example, the amount of metal may form the housing and/or the supporting structure of the phone. The metal may have the slot formed therein and the amount of metal may be sufficient to be used as the finite ground plane for the slot antenna.

A wireless connection is established based on the operating frequency (block 506). For example, one or more modules (e.g., communication module 104 from FIG. 1) may employ the slot antenna to establish a wireless connection to another device in order to transmit and/or receive data using the established frequency.

Example Device

Figure 6:
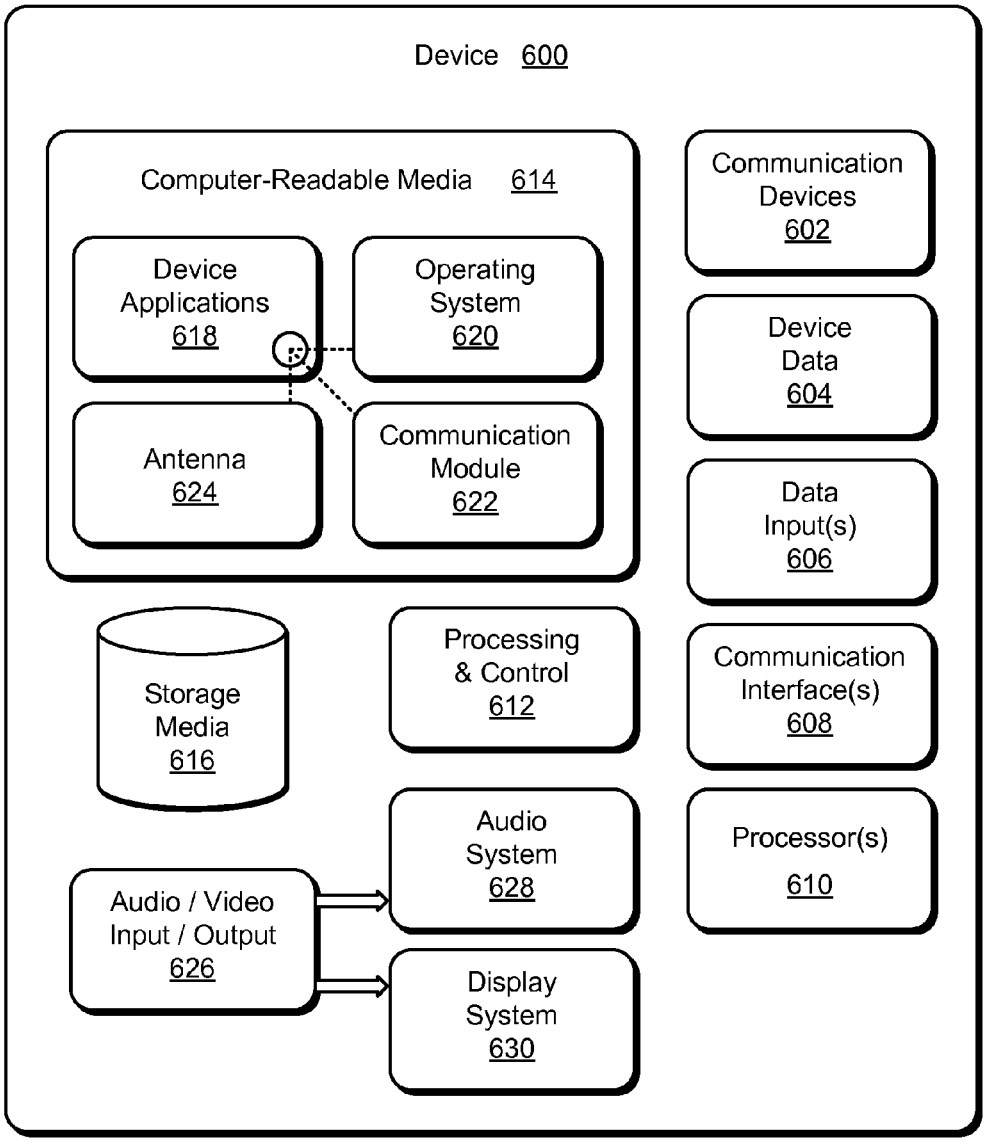
FIG. 6 illustrates various components of an example device that can be implemented as any type of portable and/or computer device as described with reference to FIGS. 1-5 to implement embodiments of the slot antenna described herein.

FIG. 6 illustrates various components of an example device 600 that can be implemented as any type of portable and/or computer device as described with reference to FIGS. 1-4 to implement embodiments of the slot antenna described herein. Device 600 includes communication devices 602 that enable wired and/or wireless communication of device data 604 (e.g., received data, data that is being received, data scheduled for broadcast, data packets of the data, etc.). The device data 604 or other device content can include configuration settings of the device, media content stored on the device, and/or information associated with a user of the device. Media content stored on device 600 can include any type of audio, video, and/or image data. Device 600 includes one or more data inputs 606 via which any type of data, media content, and/or inputs can be received, such as user-selectable inputs, messages, music, television media content, recorded video content, and any other type of audio, video, and/or image data received from any content and/or data source.

Device 600 also includes communication interfaces 608 that can be implemented as any one or more of a serial and/or parallel interface, a wireless interface, any type of network interface, a modem, and as any other type of communication interface. The communication interfaces 608 provide a connection and/or communication links between device 600 and a communication network by which other electronic, computing, and communication devices communicate data with device 600.

Device 600 includes one or more processors 610 (e.g., any of microprocessors, controllers, and the like) which process various computer-executable instructions to control the operation of device 600 and to implement embodiments described herein. Alternatively or in addition, device 600 can be implemented with any one or combination of hardware, firmware, or fixed logic circuitry that is implemented in connection with processing and control circuits which are generally identified at 612. Although not shown, device 600 can include a system bus or data transfer system that couples the various components within the device. A system bus can include any one or combination of different bus structures, such as a memory bus or memory controller, a peripheral bus, a universal serial bus, and/or a processor or local bus that utilizes any of a variety of bus architectures.

Device 600 also includes computer-readable media 614, such as one or more memory components, examples of which include random access memory (RAM), non-volatile memory (e.g., any one or more of a read-only memory (ROM), flash memory, EPROM, EEPROM, etc.), and a disk storage device. A disk storage device may be implemented as any type of magnetic or optical storage device, such as a hard disk drive, a recordable and/or rewriteable compact disc (CD), any type of a digital versatile disc (DVD), and the like. Device 600 can also include a mass storage media device 616.

Computer-readable media 614 provides data storage mechanisms to store the device data 604, as well as various device applications 618 and any other types of information and/or data related to operational aspects of device 600. For example, an operating system 620 can be maintained as a computer application with the computer-readable media 614 and executed on processors 610. The device applications 618 can include a device manager (e.g., a control application, software application, signal processing and control module, code that is native to a particular device, a hardware abstraction layer for a particular device, etc.). The device applications 618 also include any system components or modules to implement embodiments of the slot antenna described herein. In this example, the device applications 618 include a communication module 622 and an antenna 624 that are shown as software modules and/or computer applications. The communication module 104 is representative of software that is used to employ the antenna 624 for wireless communication. Alternatively or in addition, the communication module 622 and the antenna 624 can be implemented as hardware, software, firmware, or any combination thereof.

Device 600 also includes an audio and/or video input-output system 626 that provides audio data to an audio system 628 and/or provides video data to a display system 630. The audio system 628 and/or the display system 630 can include any devices that process, display, and/or otherwise render audio, video, and image data. Video signals and audio signals can be communicated from device 600 to an audio device and/or to a display device via an RF (radio frequency) link, S-video link, composite video link, component video link, DVI (digital video interface), analog audio connection, or other similar communication link. In an embodiment, the audio system 628 and/or the display system 630 are implemented as external components to device 600. Alternatively, the audio system 628 and/or the display system 630 are implemented as integrated components of example device 600.

Conclusion

Although the embodiments above have been described in language specific to structural features and/or methodological acts, it is to be understood that the subject matter defined in the appended claims is not necessarily limited to the specific features or acts described. Rather, the specific features and acts are disclosed as example forms of implementing the claimed subject matter.

What is claimed is:

1. A handheld device, comprising:

a slot antenna sufficient for wireless communication;

one or more modules communicatively coupled to the slot antenna and configured to employ the slot antenna to enable the wireless communication; and a housing comprising a first portion and a second portion that are pivotally connected to one another and foldable into a closed position, the slot antenna being disposed on the first portion, the second portion structured to not physically cover the slot antenna on the first portion when the housing is folded into the closed position.

2. The handheld device of claim 1, wherein the slot antenna is configured for multiple radios operating in different frequencies.

3. The handheld device of claim 1, wherein the slot antenna is configured for multiband functionality to establish one or more frequencies for communicating over a wireless network.

4. The handheld device of claim 1, wherein the handheld device comprises an amount of metal sufficient to establish a finite ground plane for the wireless communication.

5. The handheld device of claim 4, wherein the slot antenna is disposed proximal to at least one outer edge of the metal.

6. The handheld device of claim 1, wherein the slot antenna comprises a wideband slot antenna.

7. The handheld device of claim 1, wherein the one or more modules are configured to establish a wireless telephone connection between the handheld device and a remote device over a network.

8. The handheld device of claim 1, wherein the one or more modules are configured to establish a wireless connection between the handheld device and a remote device over a network based on an operating frequency established by the slot antenna.

9. The handheld device of claim 1, wherein the slot antenna is disposed proximate at least part of an outer edge of the first portion.

10. The handheld device of claim 9, further comprising at least one additional antenna disposed proximate at least part of an outer edge of the second portion.

11. The handheld device of claim 1, further comprising multiple antennas, at least one of said multiple antennas including the slot antenna.

12. The handheld device of claim 1, wherein the one or more modules are configured to enable the wireless communication over a wireless network that includes at least one of 3G cellular, 4G cellular, Bluetooth, Wi-Fi, or GPS.

13. A phone, comprising:

a housing comprising an amount of metal sufficient to establish a finite ground plane and a slot formed within the metal, the housing including first and second portions that are foldable into a closed position, the slot disposed on the first portion, the second portion formed to not physically cover the slot on the first portion when the phone is folded into the closed position; and one or more modules configured to use the finite ground plane and the slot as an antenna to perform wireless communication.

14. The phone of claim 13, wherein the one or more modules are configured to employ the slot as the antenna to establish an operating frequency for the communication over the wireless network.

15. The phone of claim 13, wherein the antenna is configured for multiple working modes for multiple radios operating in different frequencies.

16. The phone of claim 13, wherein the housing is foldable along a longitudinal axis into the first portion and the second portion, wherein the slot is disposed proximate at least one outer edge of the first portion, the second portion comprising at least one different antenna usable for a frequency that is different than one or more frequencies usable by the antenna.

17. The phone as recited in claim 16, wherein the second portion is configured to not block the antenna used via the slot disposed on the first portion when the phone is folded in a closed position.

18. The phone as recited in claim 13, further comprising a non-conductive filler configured to support a structure of the phone and at least partially fill the slot.

19. A method, comprising:

using a phone with a housing that includes a slot formed therein to establish an operating frequency for communicating over a wireless network, the housing comprising a first portion and a second portion that are foldable into a closed position, the slot disposed along at least one outer edge of the first portion, the second portion structured to remain within bounds of an interior wall of the slot on the first portion when the phone is folded into the closed position;

establishing a wireless connection between the phone and a remote device over the wireless network based on the operating frequency.

20. The method of claim 19, further comprising using an amount of metal located on the phone to establish a finite ground plane sufficient for communicating over the wireless network, the amount of metal configured to form the slot.

* * * * *